US007121899B2

(12) United States Patent
Homann et al.

(10) Patent No.: US 7,121,899 B2
(45) Date of Patent: Oct. 17, 2006

(54) PLUG CONNECTION FOR A MOBILE TERMINAL

(75) Inventors: Frank Homann, Steinfurt (DE); Michael Bothe, Munster (DE)

(73) Assignee: FRIWO Geratebau GmbH, Ostbevern (DE)

( * ) Notice: Subject to any disclaimer, the term of this patent is extended or adjusted under 35 U.S.C. 154(b) by 0 days.

(21) Appl. No.: 10/874,795

(22) Filed: Jun. 23, 2004

(65) Prior Publication Data

US 2005/0020133 A1 Jan. 27, 2005

(30) Foreign Application Priority Data

Jun. 25, 2003 (DE) ..... 203 09 812 U

(51) Int. Cl.
*H01R 13/64* (2006.01)

(52) U.S. Cl. ..... 439/680

(58) Field of Classification Search ..... 439/680, 439/606, 730, 79, 682, 638, 651, 736
See application file for complete search history.

(56) References Cited

U.S. PATENT DOCUMENTS

| | | | | |
|---|---|---|---|---|
| 3,654,586 | A * | 4/1972 | Winkler | 439/295 |
| 3,724,524 | A * | 4/1973 | Potter | 160/24 |
| 4,449,776 | A * | 5/1984 | Carmo et al. | 439/350 |
| 4,846,396 | A * | 7/1989 | Palazzolo | 229/117.12 |
| 5,648,712 | A | 7/1997 | Hahn | |
| 6,250,956 | B1 | 6/2001 | Pulizzi | |
| 6,559,556 | B1 * | 5/2003 | Wills | 307/10.1 |
| 2004/0251873 | A1 * | 12/2004 | Simoes et al. | 320/114 |

FOREIGN PATENT DOCUMENTS

| | | |
|---|---|---|
| DE | 4025571 | 2/1992 |
| DE | 19515822 | 8/1996 |
| DE | 29707593 U1 | 10/1997 |
| DE | 19858011 | 7/2000 |
| WO | WO 9943074 | 8/1999 |
| WO | WO 03034363 | 4/2003 |

* cited by examiner

*Primary Examiner*—Phuong Dinh
(74) *Attorney, Agent, or Firm*—Michael Best & Friedrich

(57) ABSTRACT

The present invention refers to a plug connection for a mobile terminal. In order to provide an improved plug system which overcomes the problems of known solutions, according to the present invention, a plug connection is provided for electrically connecting a power supply unit which is to be supplied with mains voltage and is arranged within a mobile terminal via a power line carrying mains voltage or via a coupling piece, which can be coupled to a conventional power line to the mains voltage. The preferably flexible power line can be coupled to the power supply unit via a plug system comprising a plug connector and a receptacle, said plug system being dimensioned in a way, that it is smaller than plug systems according to IEC 320, and that it is complying with the valid standards in respect to the contact and handling safety.

12 Claims, 5 Drawing Sheets

Fig.3A
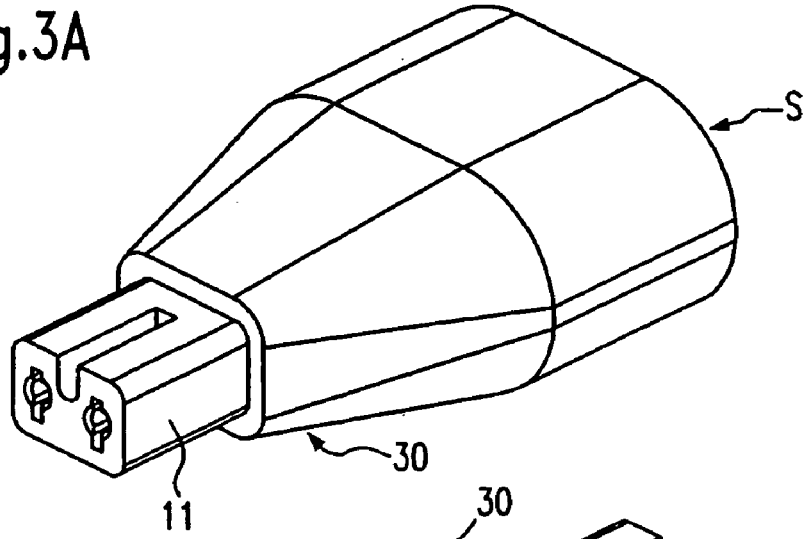
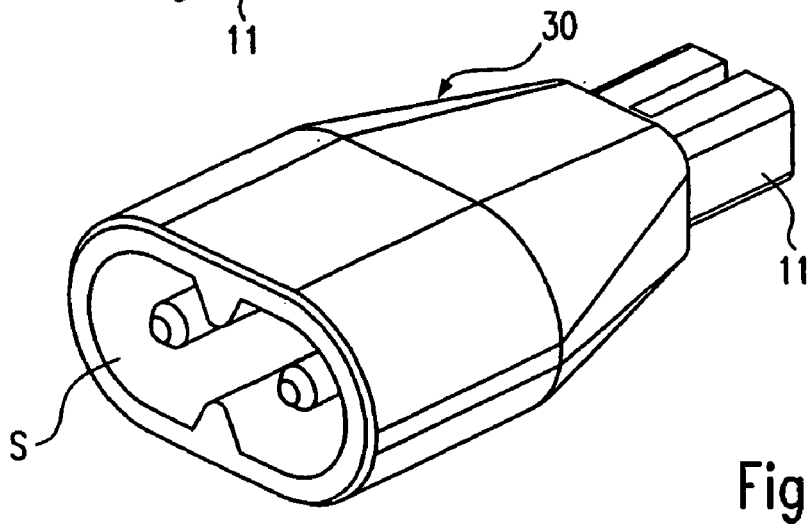
Fig.3B
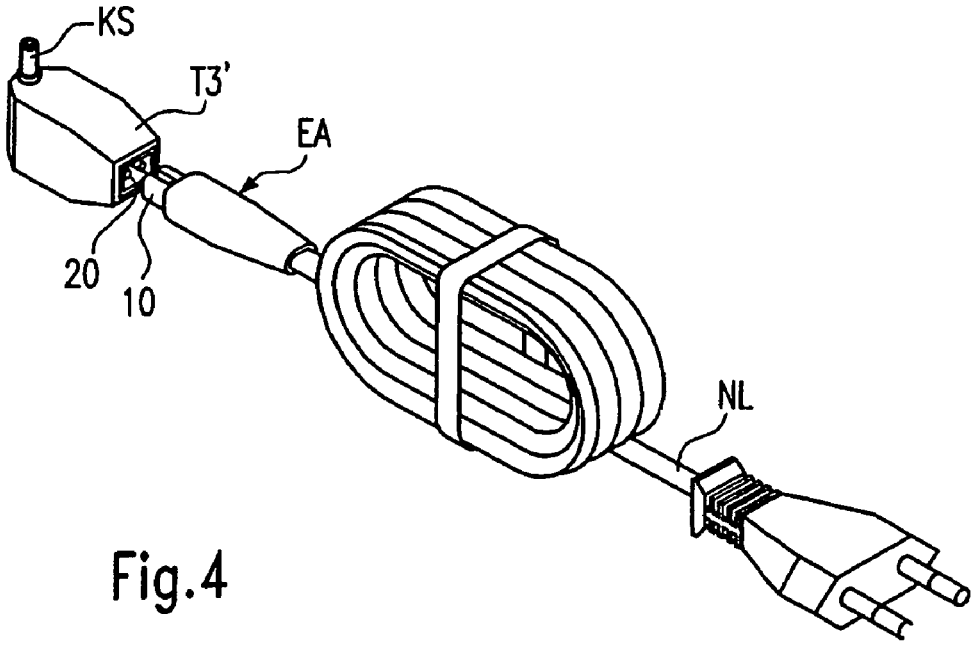
Fig.4

State-of-the-art

State-of-the-art

State-of-the-art

PLUG CONNECTION FOR A MOBILE TERMINAL

BACKGROUND

The present invention refers to a plug connection for a mobile terminal.

Today, mobile terminals are supplied mostly by external power supplies. Here, normally wall power supplies or table top units are used. Both types of devices generate a safety extra low voltage which is connected to the terminal via an output line and a connector system. Moreover, the table top unit comprises a mostly detachable AC power line for the supply with the main voltage. Further, from the international patent application WO99/43074 A1 a device for converting a voltage is known, wherein the unit for power supply of a terminal is integrated into the (output) plug of the device. Thus, the voltage drop at the output line and the efficiency factor are improved significantly.

SUMMARY

Due to the enhanced requirement of energy for mobile terminals (for instance UMTS cellular telephones) and due to the demand of shorter charging times and the use of battery systems with low cell voltages, such as lithium-polymer batteries, enhanced requirements exist for the tolerances of a charging voltage. Voltage variations of more than one percent lead to the problem, that the battery is either not charged sufficiently, and that only a part of the available operating time can be used, or that the batteries are overcharged and that their time of product life is shortened significantly. A conventional coaxial connector has, according to the data sheet of the producer, typically a transition resistance of 30 mΩ. For a charging current of 1.5 A therefore about 45 mV of the output voltage are falling at the plug. For a charging voltage of typically 4.1 V this is more than the acceptable 1%.

Furthermore, there often exists, in order to enhance the user friendliness, the demand to integrate the power supply into the terminal, as this is the case for a razor, in order to save the necessity of additional power supply devices when traveling. Here, the connection is performed via a connector system according to IEC 320 C7/C8, the so-called razor connector. This connector system is allowed for 2.5 A and is therefore widespread in low current supplies up to about 70 W.

For particularly compact applications with a power demand of less than 10 W, such as cellular telephones, MP3-players, PDA's, portable CD/DVD-players, or the like, this plug system, however, requires too much space.

The problem underlying the present invention is to provide a plug system which overcomes the above problems.

This problem is solved by providing a plug connector for a mobile terminal, in particular for a cellular telephone, preferably with integrated battery system for a power supply with low current or low battery cell voltage, wherein the power supply of the terminal is performed via an integrated power supply unit, which is supplied with mains voltage, in particular 240 VAC via a power line, wherein the preferably flexible power line may be coupled to the power supply unit by means of a connector system, which is dimensioned in a way that it is smaller than connector systems according to IEC 320 and still complies with the valid standards for contact and handling safety.

In the sense of the present invention, the term "power supply unit" signifies the voltage transformer of a terminal, for instance a transformer or piezoelectric voltage transformer, for directly supplying the electronic units of the terminal, and also signifies the voltage transformer for supplying the battery charging station of a terminal.

The terminals can be provided with an integrated battery system for an energy supply with low current (or a low battery cell voltage), or with a power supply unit (without battery system) for the direct supply to the electrical units in the terminal.

Terminals can be any known mobile terminals, such as dictaphones, notebook-computers, razors, cellular telephones, cordless telephones and the like.

In some embodiments of the present invention, a miniaturized plug connection is provided, and consists of plug and receptacle (socket) and is suitable for a rated voltage of 240 VAC and rated currents up to 0.5 A. In particular, a preferred embodiment of a device socket can be integrated into mobile terminals in a particularly room saving way. Thus, integrated power supplies can be realized, which can be connected directly to the charging unit of the battery within a terminal. They show no voltage drop at low voltage plug connectors or output lines. Further, security distances and requirements of a contact protection are complied with. Moreover, the total efficiency factor of the arrangement is improved.

For the transition from known IEC 320 power lines to the plug connection according to the present invention, a handy coupling piece is proposed. This coupling piece can also be used, when a power line according to the present invention is to be connected with a table top unit, having for instance the conventional IEC socket. Thus, an additional power line is obsolete. Users of the mobile terminal then only need said coupling piece.

Further embodiments are to be found in the dependent claims, and it is referred to their features here explicitly.

BRIEF DESCRIPTION OF THE DRAWINGS

Embodiments of the present invention are shown in detail in the figures. These figures are showing:

FIG. 3 a coupling piece for an IEC 320 power line with receptacle type C7 and a miniaturized plug connection;

FIG. 4 a miniaturized plug connection at an output plug device;

DETAILED DESCRIPTION

Figure 6A:
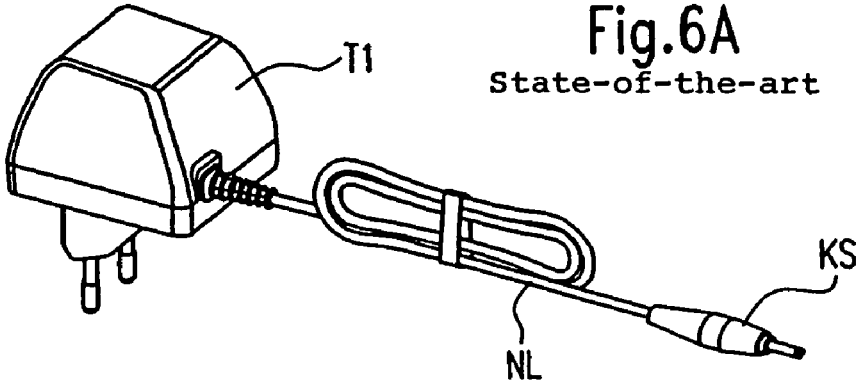
FIG. 6 prior art; a) wall plug device, b) table top unit and c) output plug power supply unit.
Figure 6B:
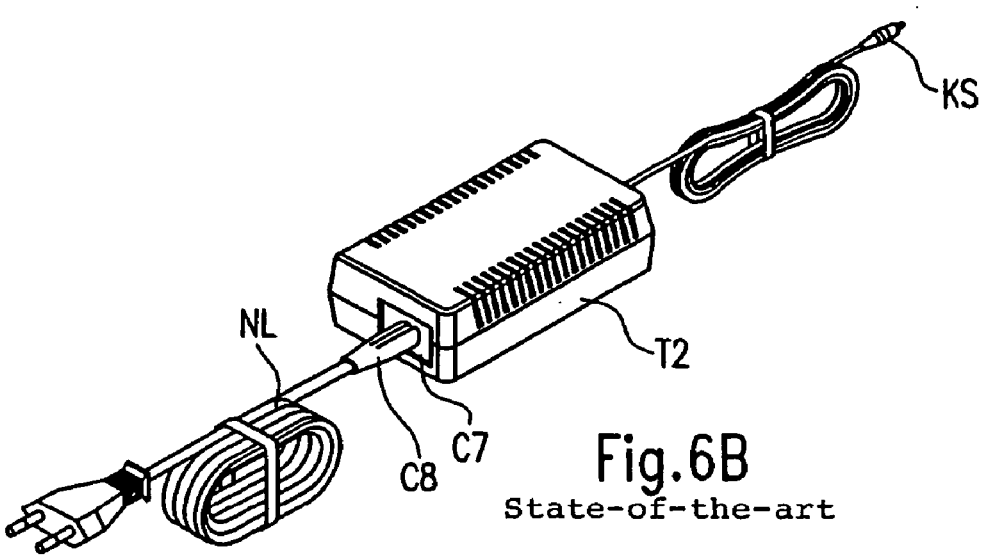
Figure 6C:
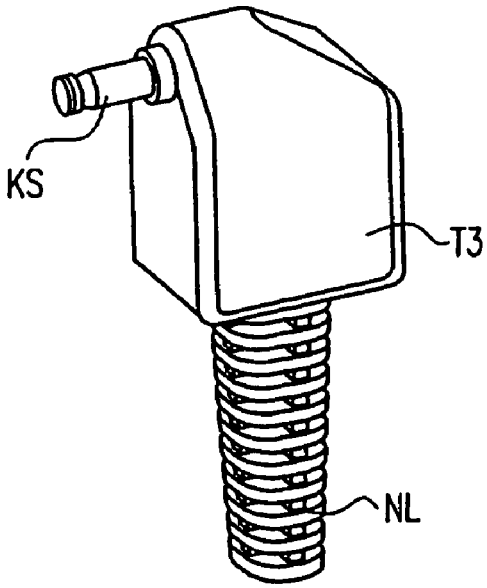

In FIG. 6 the prior art is shown. FIG. 6*a* shows a wall power supply with transformer part T1, flexible power line NL and the low voltage coaxial output plug KS. In FIG. 6*b*, a table top power supply unit T2 is shown, which is coupled detachably to the mains voltage by means of the power line NL and an IEC 320 plug connector system (C7 corresponds to the plug, C8 corresponds to the receptacle, each having two poles). At the side of the output, the low voltage again is provided at the coaxial output plug KS. In FIG. 6*c* another known variant is depicted. It is shown a so-called output plug power supply, wherein at the end of the power line NL the mains adapter or transformer part T3 is arranged, and wherein the output voltage can be collected directly at the housing of the transformer part T3 via a coaxial plug KS.

The quality of the voltage provided at the coaxial plug KS has the already mentioned restriction, that the transition resistance of the plug connector implies a voltage drop, which in most cases cannot be tolerated and which is at least disadvantageous.

Figure 1A:
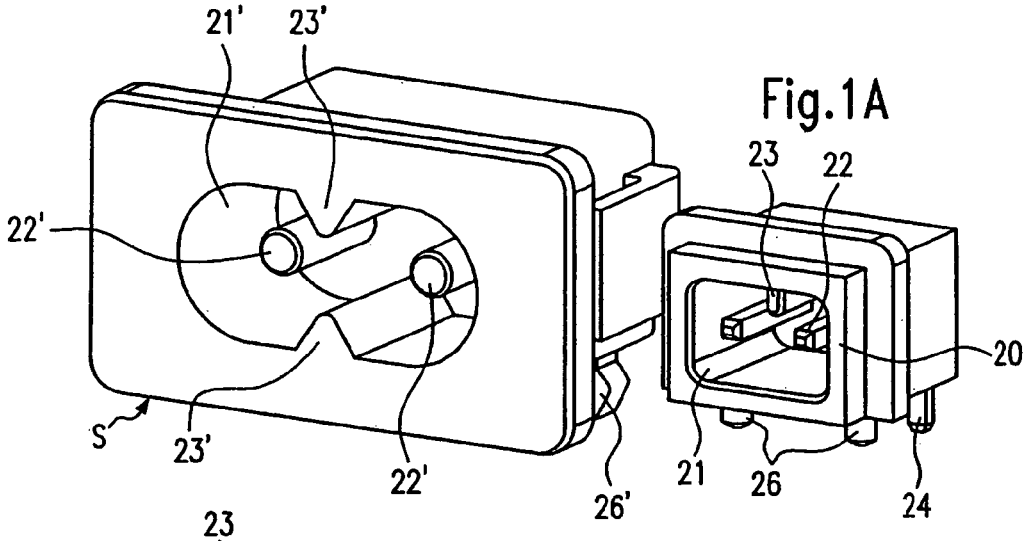
FIG. 1 a plug according to the present invention and an IEC device plug of the prior art.

A connector plug according to the present invention is shown in FIG. 1A in comparison to a C7connector plug according to the known IEC 320 (for a C8 receptacle). The dimensions are reduced significantly, however, with the same electric handling safety. In the plug funnel 21 of the connector plug 20, which can be fabricated from known insulating materials, a guiding ridge 23 for ensuring the position and pole correct plugging of a receptacle 10, according to the present invention can be seen. The receptacle 10 can be seen in FIG. 1C. The plug funnel 21 has a rectangular cross-section. This, however, is intended as an example; oval, rounded or differently formed openings of the plug funnel can also be provided according to the present invention similar to the different types of IEC 320-types (for instance C5/C6 with three poles or C7/C8with two poles).

The contact pins 22 of the connector plug have a rectangular cross-section, however, also a round cross-section belongs to the frame of the present invention. At the lower part of the connector plug 20 fixing spikes 26 and contact wires 24 can be recognized, which again are to signify an exemplary embodiment, in particular an embodiment which is suitable for a circuit board mounting (in the form of solder contacts). Of course, the contacting from the contact pins 22 of the connector plug via contact wires 24 (compare also the sectional view of FIG. 2A) to the next electrical unit (power supply or battery part) of the terminal can also be formed in any other known manner. As well as the contacting also the fixing of the connector plug within the terminal can be accomplished according to known principals. For example, a snap-in fixing, a one-part integration into the terminal housing (within an injection molding tool), screw fixings, and any other known ways of assembly can be mentioned here. The connector plug 20 has a rectangular, transversely arranged flange 25, which can be integrated within the housing wall or also on the outside rim of a housing opening.

In this relation, the possible embodiments are identical with the known assembly methods of IEC connector plugs or sockets, of which for comparison, a connector S is depicted on the left hand side of FIG. 1A. This plug is adapted for a double notch power line, and therefore comprises two guiding ridges 23' and two contact pins 22' for the two core contact to the power line. Moreover, a snap fix 26' for the mechanical fixing can partly be seen.

Figure 1B:
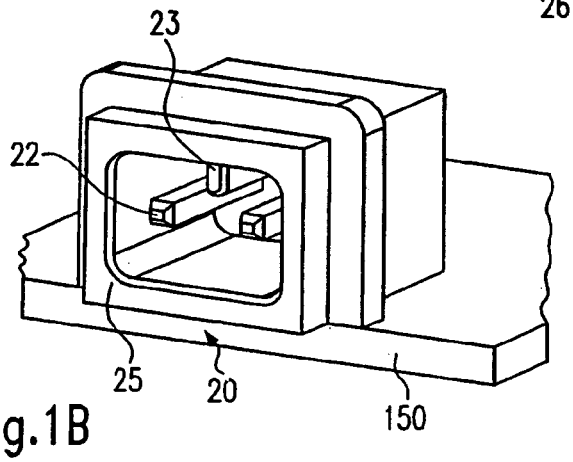
Figure 1C:
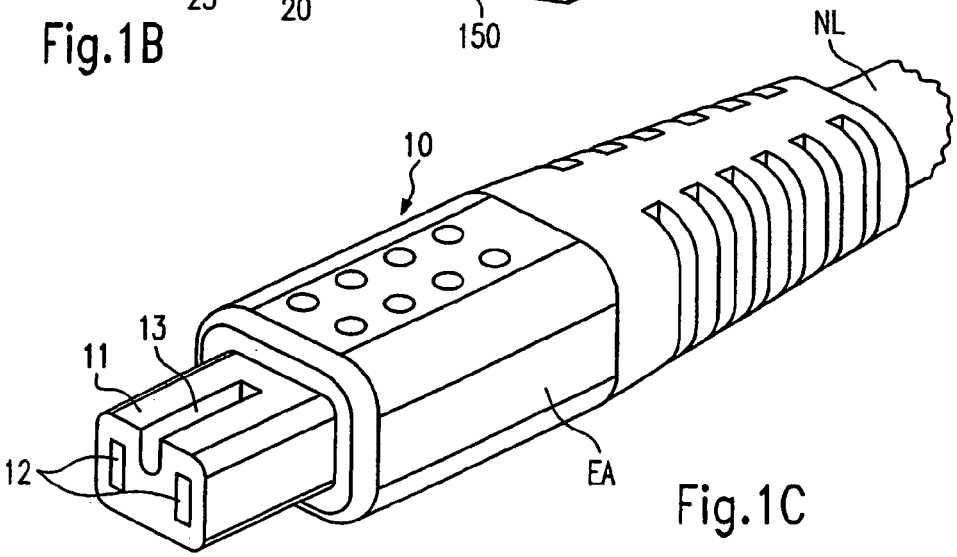

The connector plug 20 in FIG. 1B is for matching the receptacle 10 according to FIG. 1, wherein here an embodiment for mounting on a circuit board 150 is suggested.

The FIGS. 1C and 2A to 2C mainly show the receptacle 10. Same is characterized by the relatively long receptacle body 11. The receptacle body 11 which is formed from a relatively rigid or hard insulating material, is positioned and secured against strain within the end part EA of the flexible AC power line NL which (in the figures) is formed as insulated two wire line.

Figure 2A:
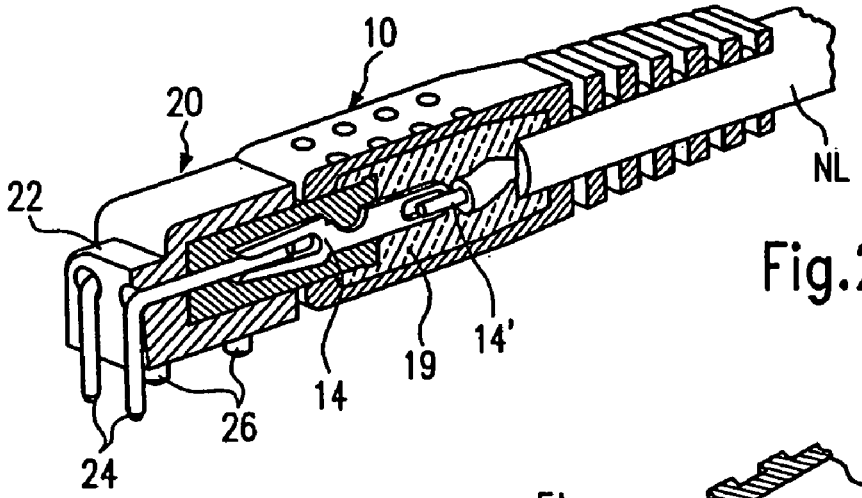
FIG. 2 a sectional view of the plug and receptacle.
Figure 2B:
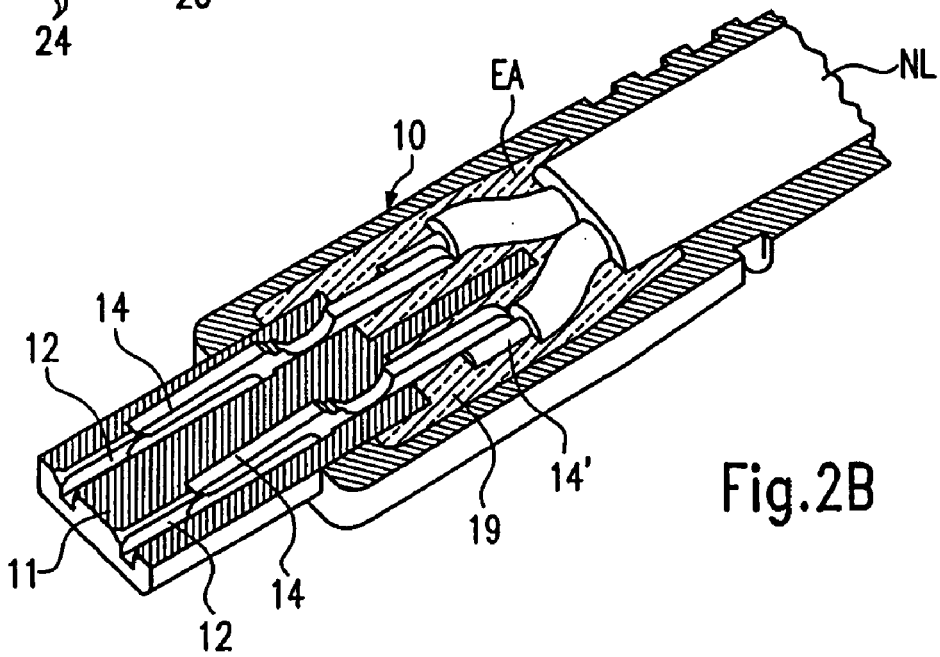
Figure 2C:
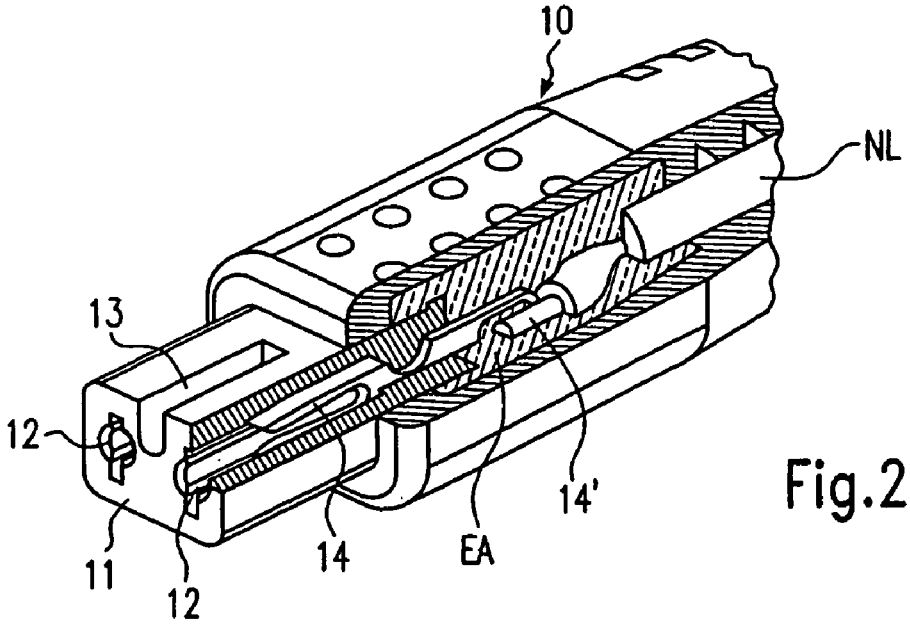

FIGS. 2A and 2C show, each in a sectional view, again the receptacle 10, wherein in FIG. 2A (corresponding to FIG. 1B) also the connector plug 20 is shown in a sectional view.5 Concerning the materials for fabricating the connector plug and the receptacle no further details have to be given for the person skilled in the art, because here a conventional and known choice can be made. It is important that the receptacle 10 is inserted into the end part EA of the AC power line NL with a strain relief. The electric contacts of the receptacle are formed as blade contacts 14. Said blade contacts are situated relatively deep within the channels of the pin receptacles 12. The channels of the receptacles 12 are formed with a round or rectangular cross-section according to the contact pins 22 of the plug connector. The contacts 14 within the receptacle can of course also be formed with a round shape as contact sleeves or in any other known manner (confer for instance to the differences according to IEC 320 between C11/C12 and C7/C8) for receiving the contact pins 22 of a connector plug. The blade contacts are connected with the conductors 14' of the power line within the inner part of the receptacle. In the sectional views a body made of insulating material and being shaped as a strain relief 19 can be seen, into which the conductors 14' of the AC power line and their insulation are embedded and secured against strain.

A relatively large depth of the channels of the pin receptacles 12, until the blade contacts are reached, is a feature that can be used for contact protection and for the security distances which have to be observed for the intended voltage level. The insertion funnels 21 of the plug connector 20 are formed accordingly deep.

FIGS. 3A and 3B show a double pole coupling piece 30 (adapter plug) between an IEC 320 AC power line and the miniaturized plug connector in two views. The plug part 11 is identical to the one from FIG. 1C. The plug S to the power line is adapted for a two core double notch line. Of course, it is clear from the embodiment of the invention, that the coupling piece 30 can also be shaped for three core power lines with an according IEC-type embodiment and a corresponding form of the plug part. Insofar, the embodiment according to FIG. 3 is not to be considered as restrictive for one particular embodiment of the coupling piece.

In FIG. 4 the miniaturized plug system is formed and shown as a connection between a two core power line NL and a output plug device T3'. The power line terminates at the side of the consumer with a receptacle 10 having an embodiment according to FIG. 1C. The connector plug 20 at the device T3' is formed correspondingly and corresponds to the embodiment of FIG. 1A. The device T3' is provided with a coaxial plug KS, wherein this particular sort of plug connection also has to be understood as exemplary, because in this figure the main issue is depicting a plug system form at a power line.

Figure 5:
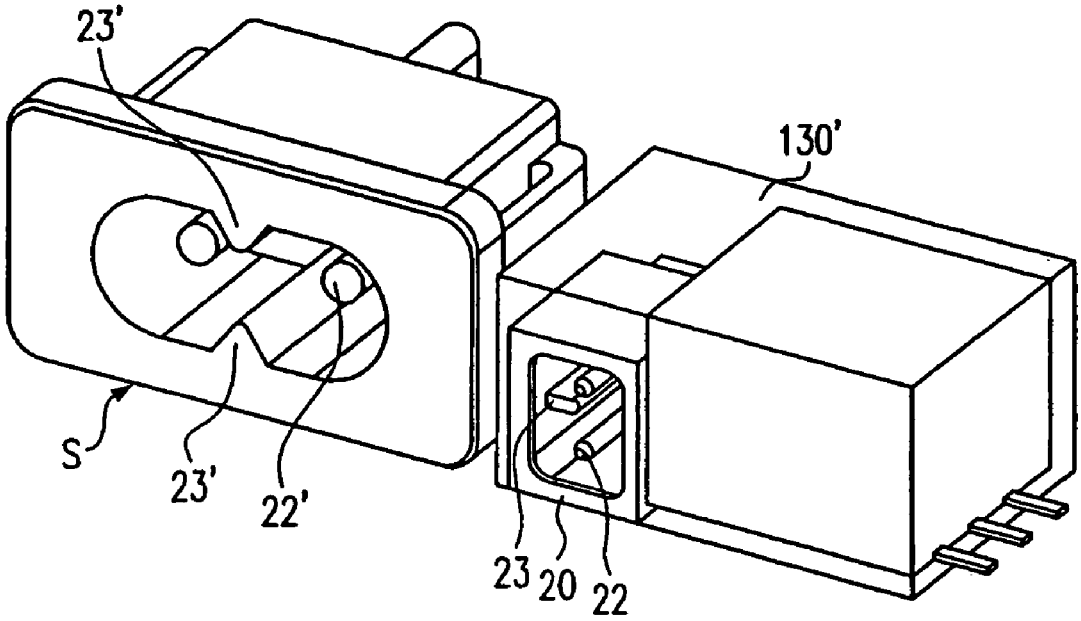
FIG. 5 a front end AC/DC module with the miniaturized plug connection.

A front end AC/DC module 130' (right hand side) with the miniaturized plug system 20 is shown in FIG. 5. The two plugs shown (IEC-connector plug S according to IEC 320 and IEC plug 20) comply in form and embodiment to the illustration of FIG. 1A. The reference numerals are the same as in FIG. 1A, so that the description has not to be repeated here.

From this illustration, in particular the minor required space for of the connector plug 20 within the unit 130' becomes clear. It is evident that the miniaturizing of the electronic units cannot be carried forward unless the electric supply lines and plug connector systems are also miniaturized.

What is claimed is:

1. A plug connection for electrically connecting a power supply unit within a mobile terminal and which is to be supplied with mains voltage via at least one of a power line carrying mains voltage or a coupling piece which can be coupled to a conventional power line to the mains voltage, wherein the power line can be coupled to the power supply unit via a plug system comprising a plug connector having first and second channels, within which are located respective contacts, and a receptacle, said plug system being dimensioned to be smaller than plug systems according to IEC 320, said plug connector defining respective depths of the channels to the contacts, wherein the sum of the respective depths is greater than that of plug connectors according to IEC 320 to maintain compliance with rated values of contact and handling safety of plug systems according to IEC 320.

2. The plug connection according to claim 1, wherein the receptacle comprises a receptacle body and an end termination of at least one of a power line and a receptacle body of a coupling piece, wherein the receptacle comprises pin channels and has a length, and wherein the length of the receptacle and the depth of the pin channels to contacts within the receptacle are dimensioned in a manner in compliance with regulations for contact safety and electric strength.

3. The plug connection according to claim 2, wherein the plug connector has a plug funnel which corresponds to a length of the receptacle body.

4. The plug connection according to claim 1, wherein the plug connector is directly formed as a plug connector for an electric input to a battery system of the mobile terminal.

5. The plug connection according to claim 1, wherein the plug connector is coupled within the mobile terminal by a snap fit.

6. The plug connector according to claim 1, wherein the plug connector is coupled within the mobile terminal as a built-in connector plug for mounting on a circuit board.

7. The plug connection according to claim 1, wherein the receptacle is formed as a built-in receptacle.

8. The plug connection according to claim 1, wherein the receptacle is formed as a termination of a power line.

9. The plug connection according to claim 8, wherein the receptacle is provided with a strain relief integrated into an end termination of the power line.

10. The plug connection according to claim 1, wherein the coupling piece is provided for the connection between a receptacle according to IEC 320 and a receptacle of a plug system dimensioned to be smaller than plug systems according to IEC 320 and in compliance with standards in respect to contacts and handling safety.

11. The plug connection according to claim 10, wherein coupling piece is provided for the connection between a receptacle according to IEC 320 of the type C8 and a receptacle of a plug system dimensioned to be smaller than plug systems according to LEC 320 and in compliance with standards in respect to contacts and handling safety.

12. The plug connection according to claim 1, wherein the mobile terminal is a telephone.

* * * * *

UNITED STATES PATENT AND TRADEMARK OFFICE

CERTIFICATE OF CORRECTION

PATENT NO. : 7,121,899 B2
APPLICATION NO. : 10/874795
DATED : October 17, 2006
INVENTOR(S) : Frank Homann and Michael Bothe It is certified that error appears in the above-identified patent and that said Letters Patent is hereby corrected as shown below:

Column 6, line 21: delete “LEC” and instead insert --IEC--

Signed and Sealed this

Sixth Day of February, 2007

JON W. DUDAS
*Director of the United States Patent and Trademark Office*